US011168713B2

(12) United States Patent
Bruck et al.

(10) Patent No.: US 11,168,713 B2
(45) Date of Patent: Nov. 9, 2021

(54) VALVE ARRANGEMENT FOR PRESSURE MEDIUM SUPPLY OF A HYDRAULIC CONSUMER

(71) Applicant: HYDAC MOBILHYDRAULIK GMBH, Sulzbach/Saar (DE)

(72) Inventors: Peter Bruck, Althornbach (DE); Marcus Karl Pfeiffer, Ramstein-Miesenbach (DE); Christian Stauch, Schwalbach (DE); Philippe Vande Kerckhove, Overijse (BE)

(73) Assignee: HYDAC MOBILHYDRAULIK GMBH, Sulzbach/Saar (DE)

( * ) Notice: Subject to any disclaimer, the term of this patent is extended or adjusted under 35 U.S.C. 154(b) by 0 days.

(21) Appl. No.: 17/052,892

(22) PCT Filed: Apr. 9, 2019

(86) PCT No.: PCT/EP2019/058885

§ 371 (c)(1),
(2) Date: Nov. 4, 2020

(87) PCT Pub. No.: WO2019/214887

PCT Pub. Date: Nov. 14, 2019

(65) Prior Publication Data

US 2021/0062832 A1 Mar. 4, 2021

(30) Foreign Application Priority Data

May 7, 2018 (DE) ..... 10 2018 003 728.3

(51) Int. Cl.
*F15B 13/04* (2006.01)
*F15B 11/044* (2006.01)

(52) U.S. Cl.
CPC ..... *F15B 13/0402* (2013.01); *F15B 11/044* (2013.01); *F15B 2211/20553* (2013.01);
(Continued)

(58) Field of Classification Search
CPC ..... F15B 2211/30535; F15B 11/044; F15B 2211/8609; F15B 2211/30555; F15B 2211/30525
See application file for complete search history.

(56) References Cited

U.S. PATENT DOCUMENTS 5,571,226 A * 11/1996 Kobayashi ..... E02F 9/226 37/348
6,438,952 B1 8/2002 Nozawa et al.
(Continued)

FOREIGN PATENT DOCUMENTS

DE 10 2009 047 035 6/2011
DE 10 2012 006 219 10/2013
(Continued)

OTHER PUBLICATIONS

International Search Report (ISR) dated Jul. 17, 2019 in International (PCT) Application No. PCT/EP2019/058885.

*Primary Examiner* — Abiy Teka
(74) *Attorney, Agent, or Firm* — Wenderoth, Lind & Ponack, L.L.P.

(57) ABSTRACT

A valve arrangement for supplying pressure medium to a hydraulic consumer has two utility ports (A, B) for fluid connection to the consumer and has a first control valve. The first control valve (20) has a first intake (24) via which a first intake flow from the first utility port (A) to the consumer (10) is controllable, has a first return control orifice (26) via which a first return flow (28) from the consumer (10) via the second utility port (B) is controllable simultaneously with the first intake (24), has a second intake (34) via which a second intake flow from the second utility port (B) to the consumer (10) is controllable, and having a second return control orifice (36), via which a second return flow (38) from the consumer (10) via the first utility port (A) is controllable simultaneously with the second intake (34). A second con-
(Continued)

trol valve (40) has an intake control orifice (42) used to control the respective intake (24, 34) of the first control valve (20).

12 Claims, 1 Drawing Sheet

(52) U.S. Cl.
CPC ..... *F15B 2211/6057* (2013.01); *F15B 2211/6313* (2013.01); *F15B 2211/8609* (2013.01)

(56) References Cited

U.S. PATENT DOCUMENTS

| | | | | |
|---|---|---|---|---|
| 7,089,733 | B1 * | 8/2006 | Jackson | F15B 11/165 60/422 |
| 2018/0017087 | A1 * | 1/2018 | Nakajima | E02F 9/2228 |

FOREIGN PATENT DOCUMENTS

| | | |
|---|---|---|
| DE | 10 2015 203 404 | 9/2016 |
| EP | 1 076 183 | 2/2001 |
| EP | 1 281 872 | 2/2003 |
| WO | 2016/091528 | 6/2016 |
| WO | 2016/124685 | 8/2016 |

* cited by examiner

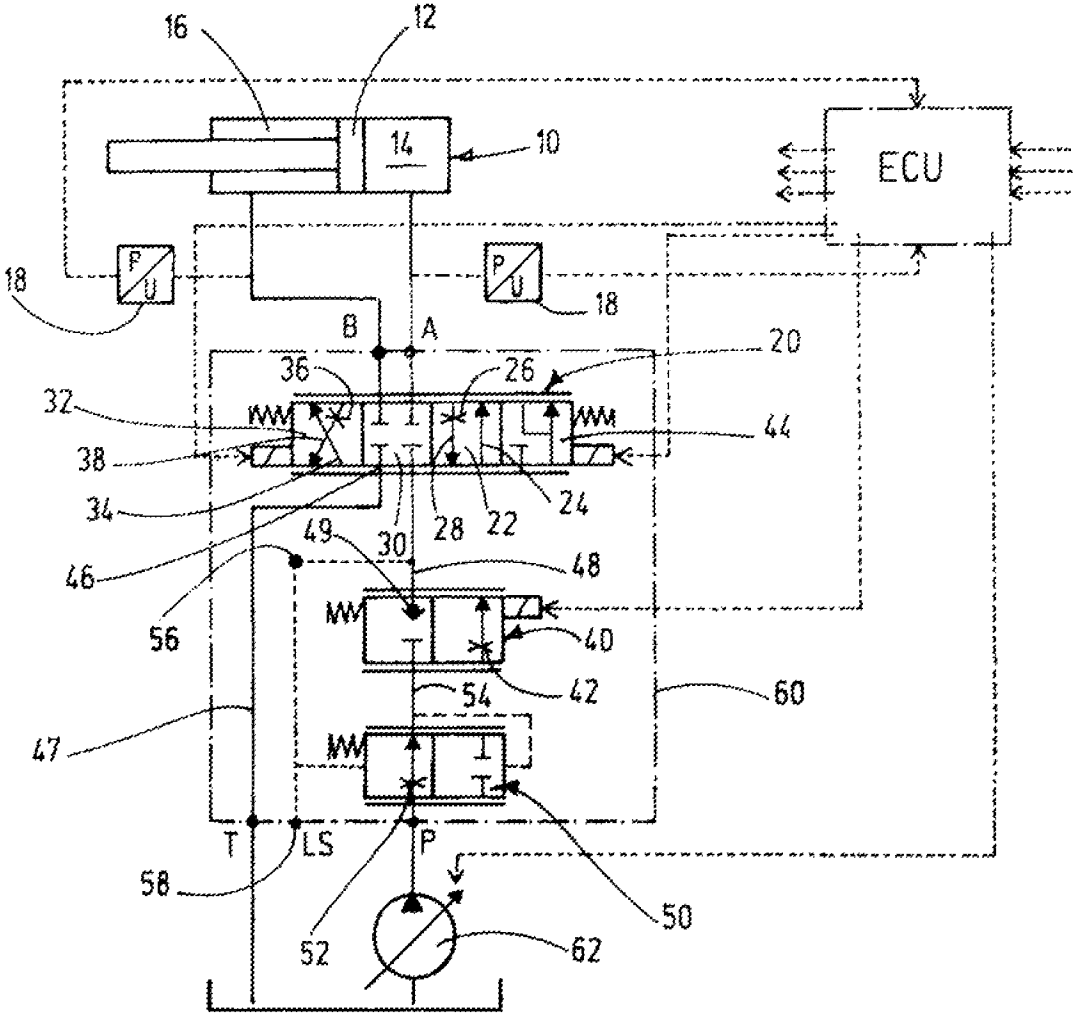
ECU
10
12
14
16
18
18
20
22
24
26
28
30
32
34
36
38
40
42
44
46
47
48
49
50
52
54
56
58
60
62
A
B
P
T
LS

VALVE ARRANGEMENT FOR PRESSURE MEDIUM SUPPLY OF A HYDRAULIC CONSUMER

FIELD OF THE INVENTION

The invention relates to a valve arrangement for supplying pressure medium to a hydraulic consumer.

BACKGROUND OF THE INVENTION

Load-sensing systems having individual pressure compensating valves upstream and downstream, which systems are also known as LS systems or LUDV systems, have become particularly popular as control concepts for such valve arrangements. Furthermore, throttle control systems in open-center circuits having constant or demand adjusted volume flow supply have become established for certain applications.

Known valve arrangements often have the characteristic of only using one control spool for changing together throttle cross sections that determine the supply and return flow of a consumer. To avoid cavitation under all circumstances in the intake line or the return line during operation of the known valve arrangement, for example when used in mobile machines, the assigned intake control orifices and return control orifices on the control spool have to be provided with control edge geometries, which are specially matched to each other. The matching of the control edge geometries is costly and time consuming since the mentioned geometries have to be individually adapted to each consumer. Also, unintentional pressure drops at such modified control edges of the valves occur in the operation of such valve arrangements, resulting in a corresponding power loss.

To counter these disadvantages, a hydraulic valve arrangement for pressure medium supply of a hydraulic consumer has been proposed in WO 2016/091528 A1. This hydraulic valve arrangement has two utility ports for connecting to the consumer. A first intake control orifice controls a first intake flow from the first of the utility ports towards the consumer. A separate second return control orifice thereof controls a first return flow from the consumer via the second utility port. A second intake control orifice controls a second intake flow from the second utility port to the consumer. A separate first return control orifice controls a second return flow from the consumer via the first utility port. Two separate pilot valves are provided with the proviso that the first return control orifice for controlling the second return flow can be controlled via the first pilot valve and with the further proviso that the second intake control orifice for controlling the second intake flow can simultaneously be controlled via the first pilot valve and the second pilot valve.

Although in this way the second intake flow and the second return flow are controlled independently of each other, which can be done largely automatically using suitable software, the first intake flow and the first return flow cannot be controlled separately from each other in such arrangements in any case, resulting in turn in an unintentional loss of pressure with the corresponding power loss at the control edges of the valves used.

In contrast, DE 10 2012 006 219 A1 is based on a completely different control approach in that a consumer having two pressure chambers is controlled digital-hydraulically. The digital-hydraulic control arrangement, used for this purpose, assigns at least one inlet valve and one outlet valve formed each as a switching valve to at least one pressure chamber of the consumer. By the inlet valve and the outlet valve, this one pressure chamber can be shut off or can be connected to a pressure medium source or to a pressure medium sink. Furthermore, a control unit is provided for actuating the inlet valve and the outlet valve such that a chamber pressure in this one or in another, further pressure chamber of the consumer or a desired consumer position can be set by compression or decompression of the pressure medium in this other pressure chamber by supplying pressure or discharging a pressure fluid volume by the inlet valve and outlet valve associated with the one pressure chamber. For this purpose, the known control arrangement uses fast switching 2/2-way valves, which can be controlled preferably using ballistic pulse width modulation (PWM). Also in such a way, the pressure medium supply of the hydraulic consumer regularly in form of a hydraulic working cylinder or hydro cylinder can be performed in digital manner by the Meter-in-Meter-our (MIMO) method.

Disadvantages of this known solution may be considered in that an increased control effort is required for controlling the plurality of switching valves by pulse width modulation, and in that the switching valves available today at a cost-effective construction regularly are not actuatable so fast to be able to fulfill satisfactorily the control task for the pressure media supply.

SUMMARY OF THE INVENTION

Based on this prior art, the invention addresses the problem of further improving the known solutions to the effect that power losses are avoided in the operation of such valve arrangements for a pressure supply to a hydraulic consumer in a cost effective, space-saving and technically reliable manner.

This problem is solved by a valve arrangement, according to the invention, for supplying pressure medium to a hydraulic consumer, with the valve arrangement having two utility ports for fluid connection to the consumer and having a first control valve. The first control valve

- has a first intake, via which a first intake flow from the first utility port to the consumer is controllable, and a first return control orifice, via which a first return flow from the consumer via the second utility port is controllable simultaneously with the first intake, and
- has a second intake, via which a second intake flow from the second utility port to the consumer is controllable, and a second return control orifice, via which a second return flow from the consumer via the first utility port is controllable simultaneously with the second intake.

A second control valve of the valve arrangement has an intake control orifice, which can be used to control the respective intakes of the first control valve.

In contrast to the solutions in the prior art, where the intake edges and drain edges of a control valve in the control spool are firmly coupled with each other, in the valve arrangement according to the invention, the corresponding control edges are formed in "separate construction units", i. e. the first control valve controls specifically via the relevant return control orifice the return of fluid from the consumer via one of the two utility ports each. The second control valve, upstream of the first control valve, selectively open- or closed-loop controls the intake flow via an intake control orifice to the consumer via one of the assignable utility ports.

The intake control orifice of the second control valve can be formed as any means for narrowing the flow cross section in the intake, for instance as a throttle.

Whereas in the known solutions, the valve spool of a control valve is designed for a defined working point with respect to a specific consumer, for example with the proviso that the valve arrangement shall be particularly suitable for pressing loads at the consumer, changing load conditions at the consumer, for example in the context of constantly changing or pulling loads, cause strong drain throttling, which in turn results in high power losses. That is avoided in a functionally reliable and cost-effective manner using the valve arrangement according to the invention.

In particular, cavitation in an intake chamber of the hydraulic consumer due to pulling loads can be avoided based on the valve arrangement according to the invention, which in addition to malfunctions, may in the long run also result in damage to the overall hydraulic system. If pressing loads occur at the consumer, the valve arrangement according to the invention can be used to avoid an emergence of an unnecessary pressure drop at the drain edge of the control valve, as the "separate" control concept, having at least two control valves connected in series. The pressure drop is kept at the drain edge of the valve, which is upstream of the consumer, at a low level, preventing an unwanted high pressure drop with corresponding power loss from occurring at the drain edge of this control valve. This arrangement is without parallel in the prior art.

In a particularly preferred embodiment of the valve arrangement according to the invention, the first intake and/or the second intake of the first control valve is in each case free of means for narrowing the flow cross section, in particular free of orifices or throttles.

In a further preferred embodiment, a third control valve, preferably in the form of a pressure compensating valve, is additionally provided and is integrated in a connection between a pressure supply for the valve arrangement and/or for the connected hydraulic consumer and the second control valve. Preferably, the third control valve is conceived such that it controls an intake between the pressure supply and the second control valve in one of its positions, using its intake control orifice and blocks this intake in another further position. In this way, the pressure difference at the second control valve downstream is controlled via the third control valve. Overall an intake volume flow control is then implemented, i. e. independently of the load situation at the consumer. A defined intake volume flow can always be adjusted in the direction of the second control valve and then towards the hydraulic consumer.

The intake control orifice of the second control valve can be formed as any means for narrowing the flow cross section in the intake, for instance as a throttle.

The invention also provides first, second and third control valves for the valve arrangement. With a maximum of only three control valves, a separated control edge design for the hydraulic consumer can be achieved in a space-saving manner, while keeping power losses low.

Other objects, advantages and salient features of the present invention will become apparent from the following detailed description, which, taken in conjunction with the drawings, discloses a preferred embodiment of the present invention.

BRIEF DESCRIPTION OF THE DRAWING

Referring to the drawing that forms a part of this disclosure that is schematic and not to scale.

The FIGURE is a hydraulic circuit diagram of the essential components of the valve arrangement according to an exemplary embodiment of the invention, with its single control valves and with an electronic control option (ECU).

DETAILED DESCRIPTION OF THE INVENTION

The valve arrangement shown in the FIGURE is used to supply pressure media to a hydraulic consumer 10, in this case in the form of a hydraulic working cylinder. The cylinder has piston rod unit 12 that divides the cylinder into two working chambers, a piston chamber 14 and a rod chamber 16. The piston chamber 14 is connected to a utility port A, and the rod chamber 16 is connected to a utility port B of the hydraulic valve arrangement. Instead of a hydraulic working cylinder a different consumer may be used, for example in the shape of a hydro-motor (not shown). One pressure transducer 18 each is integrated in the fluid connection between the utility port A and the piston chamber 14 as well as between the utility port B and the rod chamber 16. Each pressure transducer 18 transmits its measured results to a central control unit or computing unit ECU (Electronic Control Unit) for further processing.

The valve arrangement has a first control valve 20, which in one of its or first valve positions 22 controls a first intake flow from the first utility port A to the consumer 10 via a first intake 24. In this valve position 22, a first return control orifice 26 is used to route a first return flow 28 from the consumer 10 towards the tank T via the second utility port B at the same time as the first intake 24.

In the FIGURE, the first control valve 20 is shown in its blocked neutral position 30. The appropriate operation of the first control valve 20 can bring it into a third valve position 32, in the viewing direction of the FIGURE, the left switching position. In this third valve position 32, the first control valve 20 has a second intake 34, via which a second intake flow from the second utility port B to the consumer 10 is controllable. A second return control orifice 36 is present, via which a second return flow 38 from the consumer 10 via the first utility port A to the tank T is controllable simultaneously with the second intake 34.

The first and second intakes 24, 34 of the first control valve 20 are each free of means to narrow the flow cross section, in particular free of orifices or throttles.

The valve arrangement has a second control valve 40 having an intake control orifice 42, which can be used to control the respective intake 24, 34 of the first control valve 20.

The first control valve 20 is an electromagnetically actuatable 4/4-way proportional valve. In a fourth valve position 44 (shown on the far right), the first control device 20 permits a floating position for the connected consumer 10, i.e. for compensation of a pendulum volume. The piston chamber 14 is directly connected to the rod chamber 16 in the fourth valve position, wherein additional control fluid can be fed from the second control valve 40. At that, a return port 46, connected to the first control valve 20 on the input side, having a connecting line 47 to the tank T, is blocked. As the aforementioned floating position or the valve position 44 is not absolutely necessary, the valve arrangement according to the invention can also be implemented omitting this function and using an electromagnetically actuatable ¾-way proportional valve.

The first control valve 20 is, as usual and in the illustrated manner, held in its neutral position 30 in the non-energized state by two opposing compression springs. Proportional solenoids act in directions of action parallel to the respective compression spring at the valve on opposite control sides.

Each proportional solenoid can be actuated, i.e. energized, by the central control unit ECU. While the output side of the first control valve 20 is connected to the two utility ports A, B in a fluid-conveying manner, another connecting line 48, which leads to the output of the second control valve 40, is provided on the input side in addition to the connecting line 47 leading to the first control valve 20.

The second control valve 40 in turn is formed from an electromagnetically actuatable 2/2-way proportional valve. In its actuated position, the intake control orifice 42 is activated. In its un-actuated position, shown in the FIGURE, however, a possible return flow originating from the first intake 24 and the second intake 34 of the first control valve 20, is prevented, namely by a check valve 49 integrated in the second control valve 40. Check valve 49 prevents in its closed position the corresponding return from the output of the second control valve 40 in the direction of its fluid input. Preferably, the non-return valve 49 shuts off the corresponding return medium in a leak-proof manner. Also, in turn, the second control valve 40, in its de-energized state, is held in its shown blocked position by a compression spring. Only upon appropriate current supply, triggered by the central control unit ECU, the proportional solenoid, arranged opposite from the compression spring, is used to open- or closed-loop control the intake flow via the intake control orifice 42 from the input side of the second control valve 40 to its output. Instead of the proportional solenoids, the first or the second control valve 20 or 40, particularly preferred barometric pilot controls having pilot-pressure regulators can be used, in particular for relatively large dimensioned fluid cross sections.

The valve arrangement also has a third control valve 50, preferably in the shape of a pressure compensating valve, which is integrated into a connection between a pressure supply P and the second control valve 40. The third control valve 50 is preferably formed as a 2/2-way pressure compensating valve. In its neutral position shown, its intake control orifice 52 is used to control the intake flow between a pressure supply P and the second control valve 40. In the other position of this pressure compensating valve 50, the corresponding intake flow is blocked.

A load sensing pressure LS acts on the third control valve control side, facing the intake control orifice 52. The load sensing pressure LS is taken from the connecting line 48 between the first control valve 20 and the second control valve 40. A control pressure is present at its control side, facing the blocking position. The control pressure is taken from a connecting line 54 between the second 40 and the third control valve 50. Thus, the output of the third control valve 50 is permanently connected in a fluid-conveying manner to the input side of the second control valve 40 via the line 54. At the side where the load-sensing pressure LS acts on the control side of the third valve 50, the corresponding action is co-supported by a compression spring at the third control valve 50. The load-sensing pressure LS, originating from the connecting line 48, can be transferred, if required, to further valve segments (not shown) via a connection point 56. Furthermore, the load-sensing pressure LS is available at an interface 58 of the valve unit 60, including the first, second and third control valves 20, 40 and 50. Such a load-sensing pressure LS can be used, for instance, to control a swivel-angle pump 62, serving for pressure supply P. The swivel-angle pump 62 in the present case, however, is solely electrically controlled by the central control unit ECU.

The control unit or computer unit ECU shown can, as shown by arrows, receive operating commands on the input side and control some more further valve segments, not shown, on the output side.

The valve arrangement according to the invention is used to implement a resolution of control edges via a first control valve 20 and a second control valve 40. The first control valve 20 has the respective return control orifices 26 and 36 for controlling the return flow from the consumer 10. The second control valve 40 has the intake control orifice 42 for actuating the intake flow to the first control valve 20 and thus to the consumer 10. A third control valve 50 inside the valve unit 60, which is interchangeable as a whole and is also available as a retrofit kit, is formed in the manner of a pressure compensating valve and in all permits an intake volume flow control for the consumer 10.

While one embodiment has been chosen to illustrate the invention, it will be understood by those skilled in the art that various changes and modifications can be made therein without departing from the scope of the invention as defined in the claims.

The invention claimed is:

1. A valve arrangement for supplying a fluid pressure medium to a hydraulic consumer, the valve arrangement comprising:

first and second utility ports connected in fluid communication to the hydraulic consumer;

a pressure supply port;

a first control valve having a first inlet controlling a first inlet flow from the first utility port to the hydraulic consumer, having a first control orifice controlling a first return flow from the hydraulic consumer to the second utility port simultaneously with the first inlet, having a second inlet controlling a second inlet flow from the second utility port to the hydraulic consumer, and having a second return control orifice controlling a second return flow from the hydraulic consumer to the first utility port simultaneously with the second inlet;

a second control valve with an intake control orifice controlling the respective inlet of the first control valve;

a third control valve in a fluid communication connection between the pressure supply port and the second control valve, the third control valve being a 2/2-way pressure compensator controlling a supply of pressure between the pressure supply port and the second control valve, a supply control orifice of the third control valve supply pressure medium in a first position of the third control valve and blocking supply of pressure medium in a second position of the third control valve, the third control valve having a control port receiving a control pressure from a fluid communication connecting line between the second and third control valves to a blocking side of the third control valve; and a load sensing pressure control line being connected to the third control valve on a supply side of the third control valve opposite the blocking side and applying load sensing pressure to the supply side, the load sensing pressure control line being connected to a fluid communication connection line between the first and second control valves.

2. A valve arrangement according to claim 1 wherein the fluid communication connection of the third control valve between the pressure supply port and the second control valve is pressure balanced.

3. A valve arrangement according to claim 1 wherein at least one of the first inlet or the second inlet of the first control valve is without a flow constricting cross section.

4. A valve arrangement according to claim 1 wherein the first inlet and the second inlet of the first control valve are without flow constricting cross sections.

5. A valve arrangement according to claim 4 wherein only the first, second and third control valves control fluid flow between the pressure supply port and the first and second utility ports.

6. A valve arrangement according to claim 1 wherein the first control valve is at least one of a ¾-way proportional valve or a 4/4-way proportional valve being actuatable by pilot pressure regulators.

7. A valve arrangement according to claim 1 wherein the first control valve is a 4/4-way proportional valve being actuatable by pilot pressure regulators and having a floating position for the hydraulic accumulator.

8. A valve arrangement according to claim 1 wherein the second control valve is a 2/2-way proportional valve operable by a pilot pressure regulator, the intake control orifice being open for fluid flow through the second control valve in an activated state of the second control valve and blocks return flow from the first and second inlets of the first control valve in an unactivated state of the second control valve.

9. A valve arrangement according to claim 1 wherein a measurement device taps current fluid pressures at the first and second utility ports and transmits signals representative of the current fluid pressures to a control unit that initiates actuation of the first and second control valves and that control fluid pressure-supplied by a swivel-angle pump connected in fluid communication to the pressure supply port.

10. A valve arrangement according to claim 1 wherein the first control valve is connected on an input side thereof to the second control valve and comprises a return port on the input side of the first control valve.

11. A valve arrangement according to claim 10 wherein the return port is connected in fluid communication to a tank port connectable to a tank.

12. A valve arrangement according to claim 1 wherein the hydraulic consumer comprises a hydraulic working cylinder having a rod chamber and a piston chamber separated by a piston-rod unit.

* * * * *